United States Patent [19]

LaSalle et al.

[11] Patent Number: 4,966,750

[45] Date of Patent: Oct. 30, 1990

[54] HIGH DENSITY-HIGH STRENGTH URANIUM-TITANIUM-TUNGSTEN ALLOYS

[75] Inventors: Jerry C. LaSalle, Upper Montclair; Ravi Batra, Rockaway; Donald T. Rorabaugh, Budd Lake, all of N.J.

[73] Assignee: Allied-Signal Inc., Morris Township, Morris County, N.J.

[21] Appl. No.: 371,856

[22] Filed: Jun. 26, 1989

[51] Int. Cl.[5] ..... C22C 43/00

[52] U.S. Cl. ..... 420/3; 102/501; 102/517

[58] Field of Search ..... 420/3; 102/501, 517

[56] References Cited

U.S. PATENT DOCUMENTS 3,285,737 11/1966 Bellamy ..... 420/3

OTHER PUBLICATIONS

National Materials Advisory Board Report, NMA-B-350 (1980).

Eckelmeyer, "Diffusional Transformations, Strengthening Mechanisms . . . " Metallurgical Tech. of Uranium & Uranium Alloys (1981).

Roger & Hemperly, "Variable That Affect Mechanical Properties of . . . " Y-DA-6665, Union Carbide Corp., Oak Ridge, TN, (1976).

Eckelmeyer & Zanner, "Quench Rate Sensitivity In U-0.75 wt % Ti", J. of Nuc. Mat., 67, pp. 33-41 (1977).

*Primary Examiner*—Stephen J. Lechert, Jr.

*Attorney, Agent, or Firm*—Ernest D. Buff; Gerhard H. Fuchs

[57] ABSTRACT

A uranium-base alloy consists essentially of the formula $U_{bal}$—$Ti_x$—$W_y$, where x ranges from about 0.5 to 1.0 and y ranges from about 0.25 to 2.0. The alloy exhibits high strength, good ductility and high density and is especially suited for use in ballistic penetration cores.

10 Claims, 6 Drawing Sheets

* 0.2% Offset

*0.2% Offset

HIGH DENSITY-HIGH STRENGTH URANIUM-TITANIUM-TUNGSTEN ALLOYS

The U.S. Government has rights in this invention pursuant to Contract Nos. DAAK10-84-0169 and DAAA21-88-C-07 awarded by the Department of the Army.

DESCRIPTION

1. Field of the Invention.

This invention relates to high strength-high density uranium alloys, and more particularly, to ingot cast uranium-titanium-tungsten ternary metal alloys having enhanced mechanical properties compared with uranium-titanium binary metal alloys.

2. Brief Description of the Prior Art.

The need for high density ballistic alloys of improved strength and ductility has long been recognized. Uranium, with a density of 19.05 g/cm$^3$, has long been a candidate material for application in ballistic penetrator cores. Pure uranium, however, has a relatively low tensile strength of 30 ksi. As a result, extensive research was undertaken aimed at increasing the strength while maintaining useful toughness. The results culminated in the development of binary uranium—3/4Ti (wt. %) titanium alloy. Its mechanical and ballistic properties are described in the National Materials Advisory Board Report NMAB-350 (1980). This report, while recommending the use of U—3/4Ti for ballistic penetrator cores, also noted that improvement in mechanical properties must be made to address current and future counter threats in armor technology.

Typically, uranium-titanium metal alloys are cast into ingots and subsequently thermomechanically worked into plate or rod stock via techniques such as rolling or extrusion. As a final step, the alloys are given a high temperature anneal, typically at 800° C., causing the room temperature (orthorhombic) crystal structure of uranium to transform into the high temperature $\gamma$ (bcc) crystal structure. This results in solutionization of the titanium into the uranium lattice. The alloys are then rapidly quenched (greater than 100° C./sec.) to room temperature freezing the titanium into solution. Since titanium is not normally soluble in the room temperature alpha phase, a metastable martensitic variant, denoted $\acute{\alpha}_\alpha$ is formed to accommodate the supersaturated titanium.

The strengthening mechanisms in uranium-titanium alloys have been summarized by Eckelmeyer in "Diffusional Transformations, Strengthening Mechanisms, and Mechanical Properties of Uranium Alloys", from Metallurical Technology of Uranium and Uranium Alloys (1981), page 129. The strength of uranium-titanium is attributable to several mechanisms. Primary strengthening arises from solid solution strengthening resulting from titanium supersaturation of the martensite. This supersaturation is the basis for precipitation hardening, where aging at temperatures at and near 350° C. causes formation of very fine $U_2Ti$ precipitates. As aging continues the volume fraction of precipitates increases causing the strength to improve and the ductility to decrease. Ultimately, a peak in the hardness occurs beyond which both strength and ductility decrease.

It has been well documented that both strength and ductility of uranium-titanium alloys is strongly dependent on the titanium concentration. Koger and Hemperly, Y-DA-6665, Union Carbide Corp., Oak Ridge, Tenn., (1976) have demonstrated that although strength increases as the threefold drop in tensile titanium content increases from 0.7 to 0.8 (wt. %) the tensile elongation shows a threefold decrease. Thus, strengthening by titanium addition is limited due to a rapid decay of tensile elongation, a measure of ductility, beyond 98%.

SUMMARY OF THE INVENTION

The invention provides a high density-high strength uranium base alloy having increased strength compared with U—3/4Ti while maintaining equal or greater tensile elongation. This is accomplished by applying normal processing techniques for ingot uranium-titanium alloys with the modification of adding tungsten in the range of 0.25 to 2 (wt.) %.

An important attribute of tungsten is its high density of 19.25 g/cm$^3$. As a result, the strength increase resulting from the tungsten addition is obtained with no density loss. The ternary U—3/4Ti—1.0 W alloy, for example, has a measured density of 18.6 g/cm$^3$.

Evidence indicates that the addition of tungsten to U—3/4Ti increases the strength improvement by the mechanism of solid solution strengthening. This is important since Eckelmeyer and Zanner, J. of Nuc. Mat., 67, pp. 33–41, (1977) have demonstrated that excess $U_2Ti$ precipitation during the $\gamma$ quench is deleterious to ductility. The retention of tungsten supersaturation during the $\gamma$ quench is thus one of the factors responsible for the excellent tensile elongation.

The uranium-titanium-tungsten ternary alloys are heat treatable in the same manner as the binary uranium-titanium alloys. In both cases precipitation occurring in the supersaturated $\alpha_a$ (martensite) results in an increase in hardness.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF THE PREFERRED EMBODIMENTS

The invention provides a high strength uranium base alloy, consisting essentially of the formula U—$Ti_x$—$W_y$ wherein x is between 0.5 and 1.0 (wt.) % and y is between 0.25 and 2.0 (wt.) %. The combination of strength and ductility is enhanced when x ranges from about 0.7 to 0.8 and y ranges from about 0.5 to 1.0 wt. %. Consequently, uranium based composition having values for x and y components are preferred.

The alloys are a ternary modification to the binary alloy system uranium-titanium in which the titanium is added to form a martensitic variant (denoted $\acute{\alpha}_a$) of the orthorhombic ($\alpha$) uranium lattice. The martensite is supersaturated with titanium forming a substitutional solid solution. As a solid solution, a substantial strength increase is obtained compared with unalloyed uranium. The supersaturation makes the alloy amenable to a precipitation hardening reaction. This reaction occurs in the range 200°-400° C.

Useful solid solution strengthening in uranium-titanium alloys is normally limited to the composition range to 1.0 (wt.) % Ti due to a strong decrease in ductility for alloys beyond approximately 0.8 (wt.) % Ti. Alloys of the invention circumvent this problem with the ternary addition of tungsten.

The ternary tungsten addition accomplishes this strengthening without detrimental reduction in density, due to tungsten's high density of 19.25 g/cm$^3$.

The combination of high strength and high density makes the U—$Ti_x$—Wy ternary alloys ideal candidates for ballistic applications such as kinetic energy penetrators, shaped charged liners, and explosively formed penetrators.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLES 1-3

Alloys of the invention having compositions (in wt. %) listed in Table I below have been prepared using conventional ingot casting techniques. Specifically, the alloys were melted under vacuum atmosphere at approximately 1350 C and cast into billet form. Subsequently, the cooled billets had the top piece scalped and were $\alpha$ extruded at 600 C into rod form.

TABLE I

| |
|---|
| 1. U-3/4Ti-0.5W |
| 2. U-3/4Ti-0.75W |
| 3. U-3/4Ti-1.OW |

EXAMPLE 4

Figure 1A:
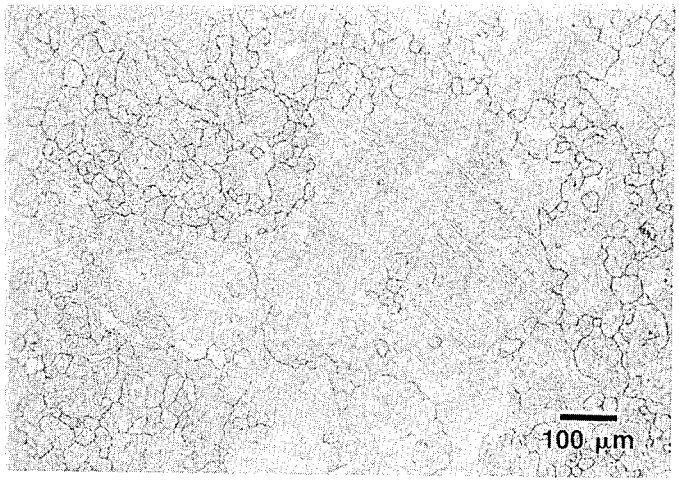
FIGS. 1*a* and 1*b* are optical micrographs of as-solutionized U—3/4Ti—0.5 W and U—3/4Ti, respectively, the micrographs revealing a similar microstructure consisting of lenticular martensite ($\acute{\alpha}_\alpha$) with some decomposed $\alpha+U_2Ti$ (grey phase), and the U—3/4Ti—0.5 W alloy showing regions of refined prior $\gamma$ grain boundaries.
Figure 1B:
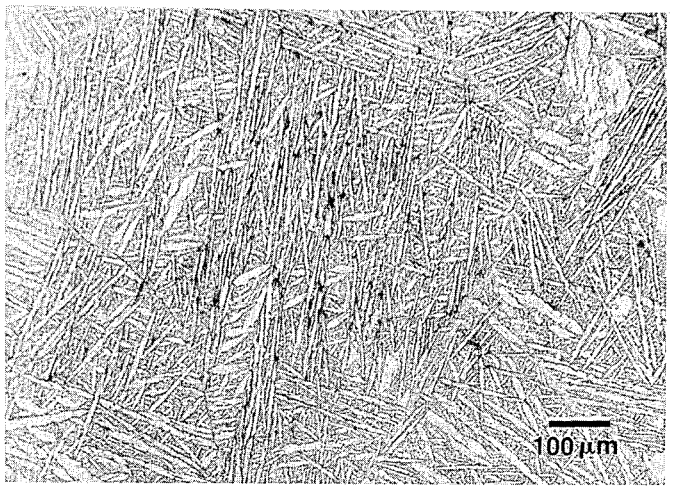

FIGS. 1a and 1b show the optical micrographs of as-solutionized U—3/4Ti—0.5 W and U—3/4Ti. Both micrographs reveal a similar microstructure of lenticular martensite ($\acute{\alpha}_a$) with some decomposed $\alpha+U_2Ti$ (grey phase). The similar microstructure for a given thermal treatment indicates that the tungsten addition is not adversely affecting the martensitic transformation behavior. Thus, the benefits of the ternary alloys may be exploited without altering the thermal processing history conventionally applied to the binary U—Ti alloys.

EXAMPLE 5

Figure 2A:
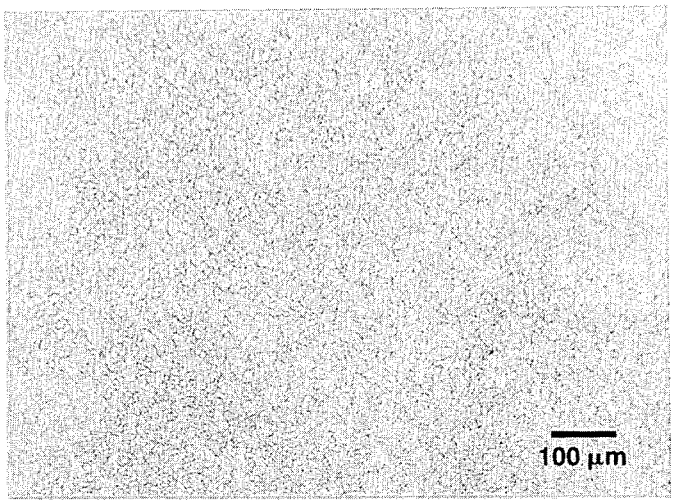
FIGS. 2*a.* and 2*b* are optical micrographs of as-solutionized U—3/4Ti—1.0 W and U—3/4Ti, respectively, the micrographs revealing a similar microstructure consisting of lenticular martensite ($\acute{\alpha}_\alpha$) with some decomposed $\alpha+U_2Ti$ (grey phase), and the U—3/4Ti—1.0 W alloy showing regions of refined prior $\gamma$ grain boundaries which are approximately 5 micrometers rather than 200 micrometers typical for U—3/4Ti.
Figure 2B:
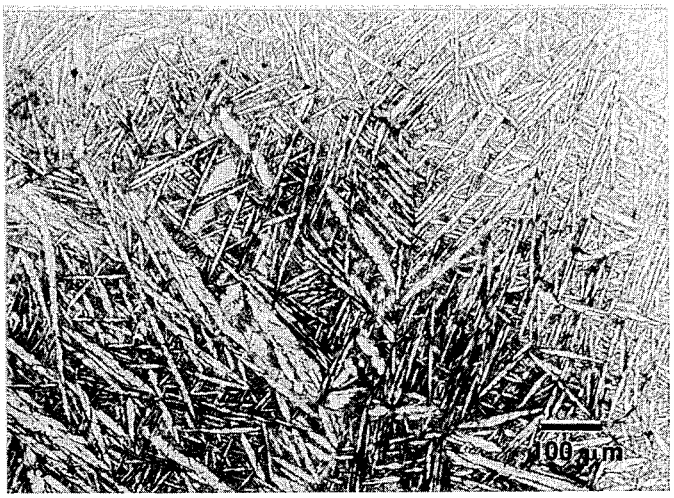

FIGS. 2a and 2b show the optical micrographs of as-solutionized U—3/4Ti—1.0 W and U—3/4Ti. Both micrographs contain lenticular martensite ($\acute{\alpha}_a$) with some decomposed $U_aTi$ (grey phase) as were seen in FIGS. 1a and 1b. The U—3/4Ti—1.0 W alloy (FIG. 2a), however, shows a much refined prior $\gamma$ grain size of approximately 5 micrometers compared with a prior $\gamma$ grain size of 200 micrometers typical for the binary U—3/4Ti. This grain size refinement makes an important contribution to the strength of the alloy via the well known empirical Hall-Petch relationship:

$$\sigma_t=\sigma_o+Kd^{(-\frac{1}{2})}$$

where $\sigma_t$ is the total yield strength, $\sigma_o$ the yield strength component of a material independent of the grain boundary contribution, K is a constant typically 0.4 Mpa m/$^{\frac{1}{2}}$ and d the grain size. Using this relationship, the strength gain due to refinement of the prior $\gamma$ grain size from 200 to 5 micrometers is estimated to be 20 ksi.

Figure 3A:
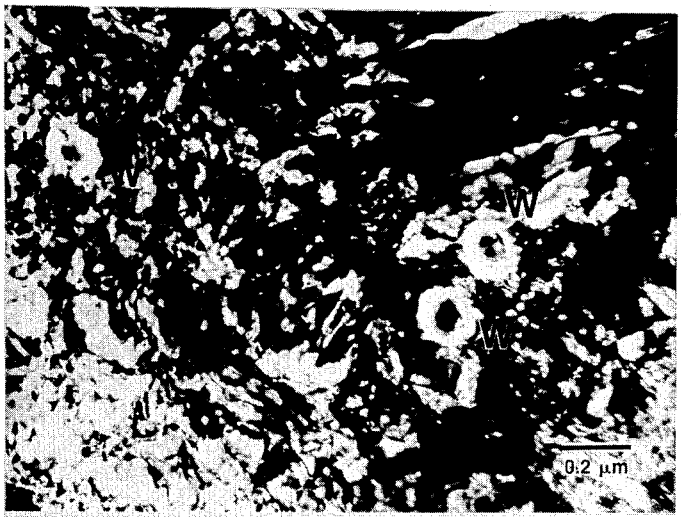
FIGS. 3*a*, 3*b*, and 3*c* is a transmission electron micrograph (TEM) of the U—3/4Ti—1.0 W alloy and Energy Dispersive Spectrographs (EDS) of the matrix and dispersoids, respectively, the EDS indicating that the dispersoids in the micrograph are essentially tungsten with a minor fraction of titanium.
Figure 3B:
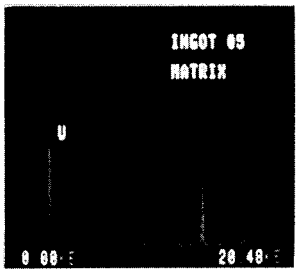
Figure 3C:
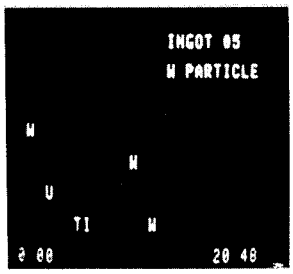

The refinement of the prior $\gamma$ grain size attained in the U=3/4Ti—W alloys results from pinning of the $\gamma$ grain boundaries during the high temperature $\gamma$ solutionization by novel dispersoids consisting primarily of tungsten, illustrated in the bright field transmission electron micrograph (TEM) of FIG. 3a. the composition of these dispersoids was determined using Energy Dispersive X-ray Spectroscopy (EDS) during TEM with the EDS spectra from the matrix and dispersoid shown in FIG. 3b and 3c.

EXAMPLE 6

Alloys in Example 1 through 3 are vacuum solutionized at 800° C. for 4 hrs. and water quenched. The alloys are then machined into subscale tensile specimens with a 0.16 inch gauge diameter and 0.64 inch gauge length and tensile tested at room temperature. These results are listed in Table II. For reference, the as-solutionized tensile data for U—3/4Ti is listed. The effect of tungsten content on the yield and ultimate tensile strength is shown in FIGS. 4a and 4b which are plots of the data of Table II.

TABLE II

| Composition | 0.2% Yield Strength (Ksi) | Ultimate Tensile Strength (Ksi) | % Elongation to Fracture | % Reduction of Area |
|---|---|---|---|---|
| U-3/4Ti | 99 | 203 | 23 | — |
| U-3/4Ti-0.5W | 112 | 204 | 23 | 48 |
| U-3/4Ti-0.75W | 130 | 220 | 18 | 24 |
| U-3/4Ti-1.OW | 150 | 240 | 3 | — |

Figure 4A:
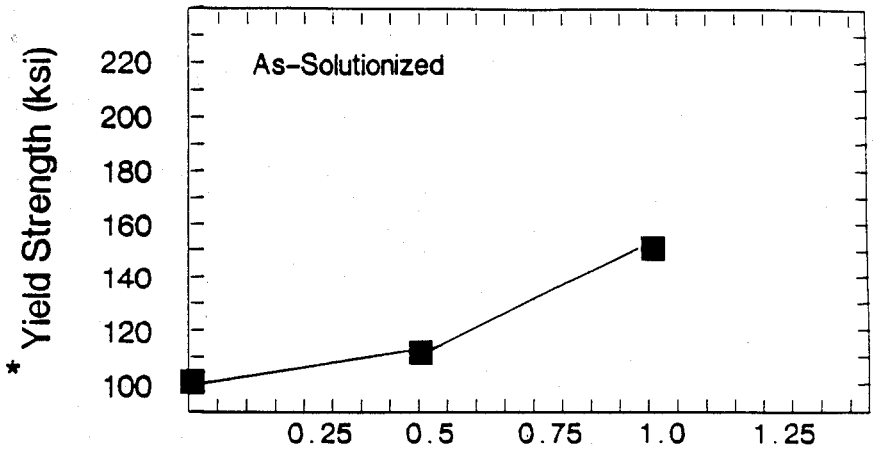
FIGS. 4*a* and 4*b* are plots of the 0.2% yield strength and ultimate tensile strength of as-solutionized U—3/4Ti—$W_x$ ternary alloys as a function of tungsten content (in wt. %), the samples having been solutionized in vacuum at 800° C. for 8 hrs. and water quenched.
Figure 4B:
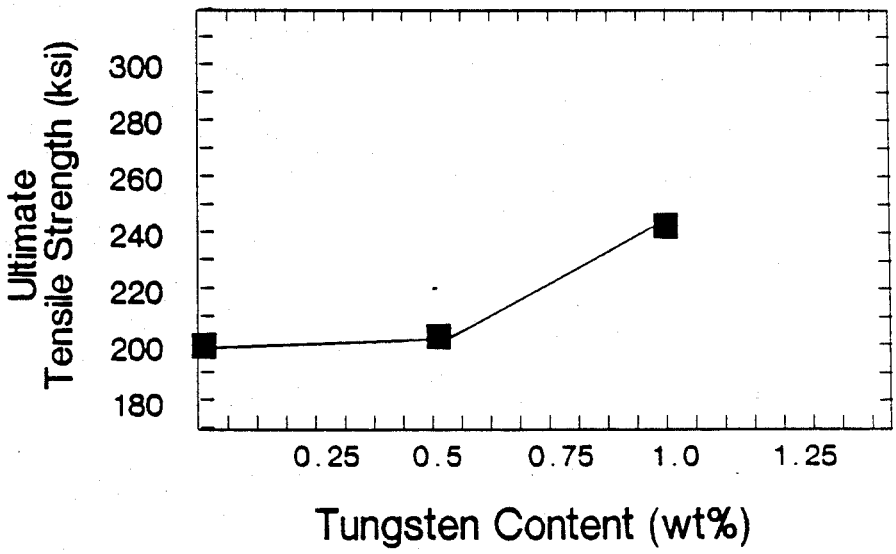

The tensile properties set forth in Table II and FIGS. 4a and 4b show that the yield and ultimate strength increase with increasing tungsten content.

EXAMPLE 7

Figure 5:
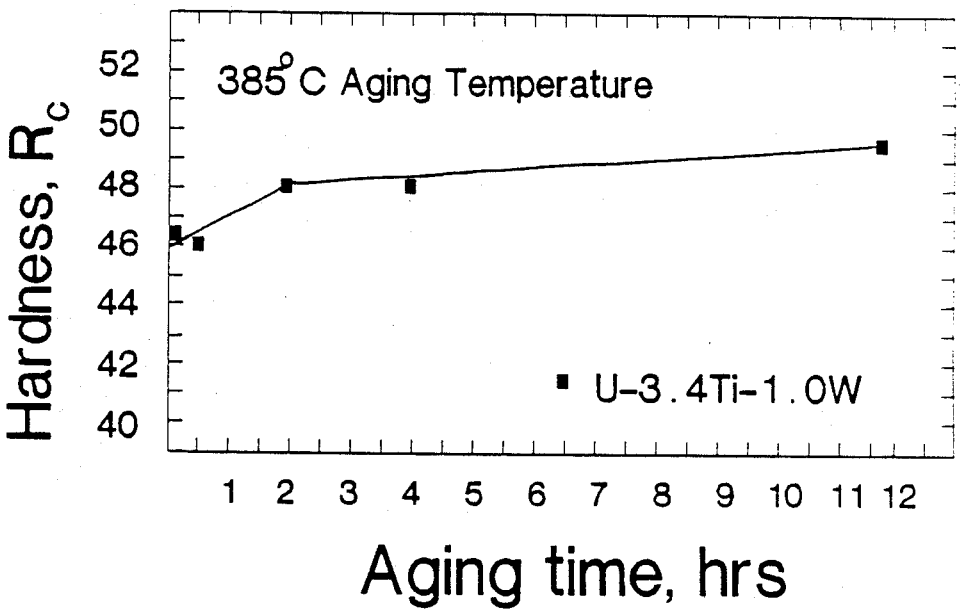
FIG. 5 is a graph showing hardness vs. aging time at 385° C., the sample having been initially solutionized in vacuum at 800° C. for 8 hrs. and water quenched.

This example illustrates that the ternary U—3/4Ti—W alloys are amenable to precipitation hardening in a manner similar to U—3/4Ti. Hardness samples were prepared by solutionizing specimens in the manner described in Example 6 and then aging them for various times in a salt bath at 385° C. FIG. 5 plots the result hardness as a function of aging time. The U—3/4Ti—1.0 W alloy shows a hardening response indicating that precipitation strengthening found in the binary U—Ti alloys is retained in the ternary U—Ti—W alloys.

EXAMPLE 8

The improved strength-ductility combination in U—$Ti_x$—$W_y$ compared with the binary U—Ti alloys occurs not only in the as-solutionized condition but also in the aged condition. This is illustrated by performing tensile tests in a manner identical to that of Example 6. In this example, however, an aging treatment of 385° C. for 4 hrs. is added after the solutionization. The resulting data is listed in Table III along with that of identically aged U—3/4Ti for reference.

Figure 6A:
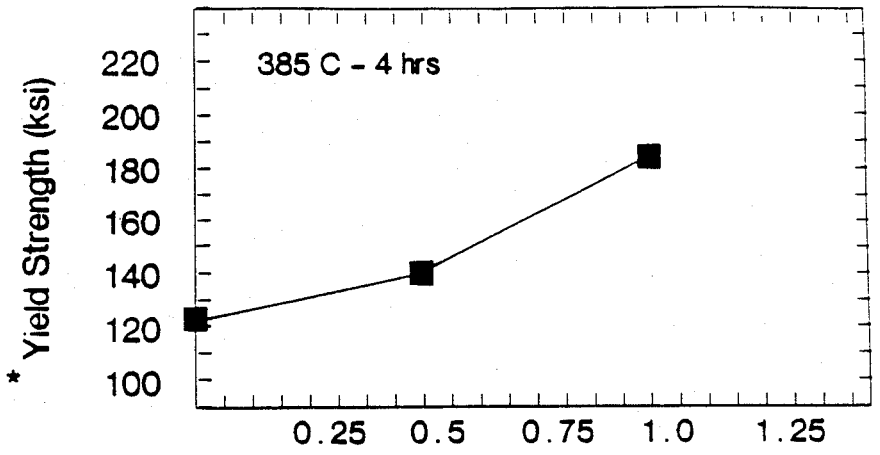
FIGS. 6a and 6b are plots of the 0.2% yield strength and ultimate tensile strength of solutionized+aged U=3/4Ti—$W_x$ ternary alloys as a function of tungsten content (in wt. %), the samples having been solutionized in vacuum at 800° C. for 8 hrs. and water quenched followed by an 8 hr. age at 385° C.
Figure 6B:
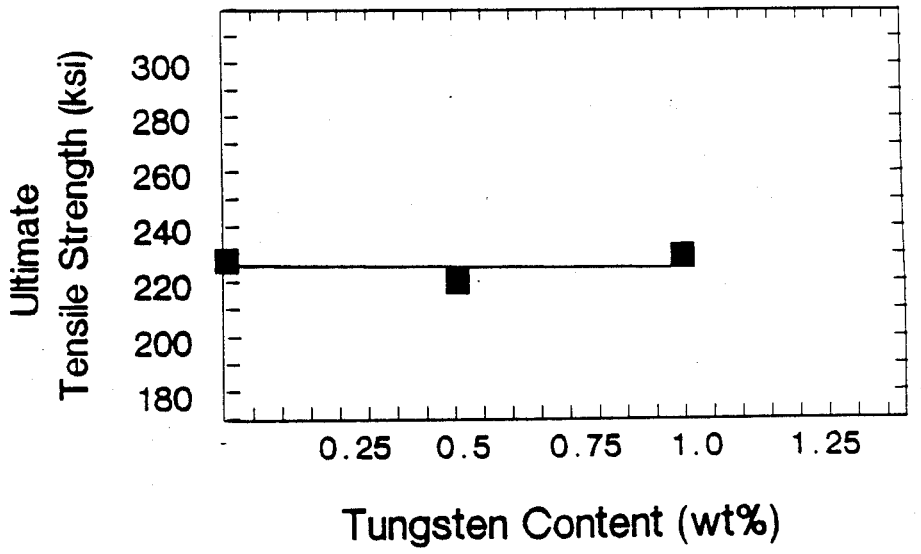

The data reveal that the 385° C. aged ternary U—3/4Ti—$W_y$ alloys show higher strength than U—3/4Ti as was the case with the unaged material. Comparison of Table III and Table II also indicates that the aging caused an average 20 ksi yield strength improvement for any given composition. This is another illustration of the precipitation hardening behavior presented in Example 7, i.e. that the strength of the ternary U—3/4Ti—W alloys increases in a manner similar to U—3/4Ti. The variation of tensile properties of the aged material as a function of tungsten content is further illustrated in FIGS. 6*a* and 6*b*. The behavior is similar to that observed in FIGS. 4*a* and 4*b*.

TABLE III

| Composition | 0.2% Yield Strength | Ultimate Tensile Strength | % Elongation to Fracture | % Reduction of Area |
|---|---|---|---|---|
| U-3/4Ti | 118 | 201 | 22 | 24 |
| U-3/4Ti-0.5W | 140 | 219 | 23 | 48 |
| U-3/4Ti-0.75W | 165 | 220 | 15 | 24 |
| U-3/4Ti-1.0W | 186 | 224 | 2 | 2 |

Having thus described the invention in rather full detail, it will be understood that these details need not be strictly adhered to but that various changes and modifications may suggest themselves to one skilled in the art, all falling within the scope of the invention as defined by the subjoined claims.

What is claimed is:

1. A high density uranium-based alloy, consisting essentially of the formula U—$Ti_x$—$W_y$ where x ranges from about 0.5 to 1.0 and y ranges from about 0.25 to 2.0.

2. An alloy as recited by claim 1, wherein x ranges from about 0.7 to 0.8 wt. % and y ranges from about 0.5 to 1.0 wt. %.

3. An alloy as recited by claim 1, said alloy has a microstructure substantially the same as that of a binary uranium base, titanium containing alloy

4. An alloy as recited by claim 1, wherein y ranges from about 0.75 to 1.0 and said alloy has a microstructure comprising refined prior gamma grain boundaries having a size of the order of about 5 micrometers.

5. A high density uranium-based alloy, consisting essentially of the formula U—$Ti_x$—$W_y$ where x ranges from about 0.55 to 1.0 and y ranges from about 0.25 to 2.0, said alloy as solutionized having a yield stress of at least 112 ksi with a minimum of 23% tensile elongation and 48% tensile reduction of area.

6. An alloy as recited by claim 5, said alloy as-solutionized having a yield stress of at least 150 ksi with a minimum 240 ksi ultimate tensile strength.

7. An alloy as recited in claim 5, said alloy as-solutionized to undergo precipitation hardening.

8. A high density uranium-based alloy, consisting essentially of the formula U—$Ti_x$—$W_y$ where x ranges from about 0.5 to 1.0 and y ranges from about 0.25 to 2.0 said alloy, upon being aged, having a yield stress of at least 140 ksi with a minimum 23% tensile elongation and 48% reduction in area.

9. An alloy as recited by claim 8, said alloy, upon being aged, having a yield stress of at least 186 ksi with a minimum 224 ultimate tensile strength.

10. An alloy as recited by claim 1, said alloy having a composition U—3/4Ti—$W_y$ and having a density of at least 18 g/cm$^3$.

* * * * *